US006226466B1

(12) United States Patent
Ojima et al.

(10) Patent No.: US 6,226,466 B1
(45) Date of Patent: May 1, 2001

(54) IMAGE FORMING APPARATUS THAT PERFORMS IMAGE DENSITY CONTROL

(75) Inventors: Masaki Ojima, Mishima; Yoichiro Maebashi, Numazu, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/286,445

(22) Filed: Apr. 6, 1999

(30) Foreign Application Priority Data

Apr. 9, 1998 (JP) ..... 10-114272

(51) Int. Cl.[7] ..... G03G 15/00
(52) U.S. Cl. ..... 399/49; 399/55
(58) Field of Search ..... 399/44, 46, 49, 399/55, 58, 59, 72

(56) References Cited

U.S. PATENT DOCUMENTS 5,351,107 * 9/1994 Nakane et al. ..... 399/49
5,424,809 6/1995 Sawayama et al. ..... 355/208
5,481,340 * 1/1996 Nagao et al. ..... 399/72
5,666,588 9/1997 Uchiyama et al. ..... 399/44
5,873,010 2/1999 Enomoto et al. ..... 399/39

FOREIGN PATENT DOCUMENTS 4-336551 11/1992 (JP) .
5-303254 11/1993 (JP) .

* cited by examiner

*Primary Examiner*—Arthur T. Grimley
*Assistant Examiner*—Hoan Tran
(74) *Attorney, Agent, or Firm*—Fitzpatrick, Cella, Harper & Scinto

(57) ABSTRACT

An image forming apparatus includes an image forming section, a density detecting device, and a controller. The controller varies density target values set in accordance with the conditions for image forming on a recording material by the image forming section on the basis of the change in the density characteristics of a plurality of pattern images detected by the density detecting device.

25 Claims, 9 Drawing Sheets

IMAGE FORMING APPARATUS THAT PERFORMS IMAGE DENSITY CONTROL

BACKGROUND OF THE INVENTION

1. Field of the Invention

The present invention relates to an image forming apparatus of an electrophotographic system or an electrostatic recording system employed for, for instance, a printer or a copying machine, and more particularly to density control therefor.

2. Related Background Art

As an example of conventional image forming apparatuses, a color image forming apparatus of an electrophotographic system is illustrated in FIG. 8.

The color image forming apparatus has a photosensitive drum 1 as an image bearing member. The photosensitive drum 1 is rotated in the direction shown by an arrow mark by a driving means not shown. The surface of the photosensitive drum 1 is uniformly charged by a primary charging roller 2 serving as a charging means abutting against the photosensitive drum 1 during its rotation. Then, the surface of the photosensitive drum 1 is irradiated with a laser beam L in accordance with a yellow image pattern by an exposure device 3 (laser scanner) so that an electrostatic latent image is formed on the surface of the photosensitive drum 1. In this case, the charging roller 2 and the exposure device 3 serve as an electrostatic image forming means for the photosensitive drum 1.

A latent image formed on the photosensitive drum 1 is reversely developed by a developing device y with yellow toner charged with negativity contained therein, which is previously opposed to the photosensitive drum 1, as the photosensitive drum 1 rotates. On a rotary support member 5 (rotary drum) are supported four developing devices 4*y*, 4*m*, 4*c* and 4*k*. Before a development operation, a prescribed developing device is rotated and moved to a developing position opposed to the photosensitive drum 1. The latent image is visualized as a yellow toner image in accordance with the development.

The toner image obtained on the photosensitive drum 1 is transferred (primary transfer) onto the surface of an intermediate transfer belt 6 rotating in the direction shown by the arrow mark at the substantially same speed as that of the photosensitive drum 1 by a primary transfer roller 7*a* to which primary transfer bias is applied. The toner remaining on the surface of the photosensitive drum 1 after transfer is removed by a cleaning means such as a blade.

A process comprising charging, an exposure, a development and a primary transfer as described above is carried out for each of colors including magenta, cyan and black subsequently to yellow, hence a multicolor image obtained by superposing together the toner images of four colors is formed on the intermediate transfer belt 6.

The multicolor image formed on the intermediate color transfer belt 6 is transferred onto the surface of a transfer material serving as a recording material which is completely conveyed to the intermediate transfer belt 6 by conveying means such as pick-up rollers 9 at a prescribed timing by a secondary transfer roller 7*b* to which a secondary transfer bias is applied (secondary transfer).

The transfer material to which the multicolor image is conveyed to a fixing device 11 by a conveyor belt 10 in which toner is melted and fixed to the transfer material under heating and pressure, hence the multicolor changes to a final color image.

Upon the use of the image forming apparatus described above, is required such maintenance as the replenishment of toner, the treatment of waste toner, the replacement of a worn (consumed) photosensitive drum 1 by a new drum. In this example of the prior art, the photosensitive drum 1, the charging roller 2 and the cleaning means 8 are formed as an integrated process cartridge 13. Further, the developing devices 4*y*, 4*m*, 4*c* and 4*k* are each formed also as a developing process cartridge and are respectively readily detachably attachable to an apparatus main body, so that a user can perform a maintenance of them with ease.

Image forming apparatuses as well as the image forming apparatus of this example are generally provided with adjusting mechanisms for adjusting the density of an output image. Most of them have density control means for automatically controlling the output image to have proper density. Especially, in the image forming apparatus for outputting a full color image as in the present example, a more accurate density control has been demanded for each of the colors of yellow, magenta, cyan and black in order to obtain a desired color balance.

According to this example, the density of the output image is detected in such a manner that the toner image of a specific halftone pattern due to area gradation is formed on the photosensitive drum 1 and the amount of reflection light of the halftone pattern on the photosensitive drum 1 is measured by a reflection light amount sensor 12 which comprises a light emitting element and a light receiving element. Since the density of an image is controlled on the basis of image forming conditions such as the charging potential of the photosensitive drum 1, exposure potential after the exposure of laser, developing bias potential, etc., a plurality of halftone patterns are formed by changing stepwise or gradually one or the combinations of a plurality of conditions of the image forming conditions and the reflection light amount of them is respectively measured by the reflection light amount sensor 12. Thus, based on the measured reflection light amount, an image forming condition from which it is estimated that a desired constant density (reflection light amount) can be obtained is obtained.

In this connection, the reflection light amount sensor 12 employs infrared light and is designed to estimate the quantity of toner on the photosensitive drum 1 regardless of the color of toner. Although the amount of infrared light 3 received by the reflection light amount sensor 12 is substantially directly proportional to or inversely proportional to the quantity of toner sticking to the photosensitive drum 1, the quantity of toner sticking to the drum is not ordinarily proportional to the density of an output image. However, since the quantity of toner sticking to the photosensitive drum is correlated with the density of the output image in the ratio 1:1, the density of the output image can be estimated from the measured value of the reflection light amount sensor 12.

A density control for the image forming apparatus of the present example will be described in detail hereinafter. In the present example of the prior art, it is assumed that the surface of the photosensitive drum 1 is charged with electricity so that the surface potential of the photosensitive drum 1 reaches −600V and that the sensitivity of the photosensitive drum 1 and the exposure amount of laser are adjusted so that the potential of a laser exposure part reaches about −200V under normal temperature and normal humidity (23° C., 60%Rh). Further, as a detecting pattern image, is used a halftone pattern (9/16) for printing 9 dots of the matrix of 4×4 dots as shown in FIG. 5. At this time, the developing bias formed by superimposing the AC (alternative current) voltage of rectangular wave (frequency of 2000 Hz, amplitude of 1600 Vpp) upon DC (direct current) voltage as shown in FIG. 4 is employed and a DC voltage component Vdc is changed so that the development amount of toner is controlled.

Prior to a normal image forming, as shown in FIG. 6 a plurality of image patches with the above described halftone pattern patches of square with side of 30 mm are printed at intervals in a section in which the reflection light amount sensor 12 is disposed. Each of the image patches is developed with the developing bias of a respectively different DC voltage component and the reflection light amount of each of the image patches is measured by the reflection light amount sensor 12. In this example, the number of the image patches is five and the DC voltage component Vdc of the developing bias is changed at intervals of 50V from −300V to −500V.

An example of measured results of reflection density is illustrated in FIG. 9. In this example, the target value (proper density) of the reflection density of the above described halftone pattern is set to 1.0 and an image after that is controlled to be formed based on a developing condition (in this example, the DC voltage component of the developing bias) under which the reflection density is estimated to be nearest to the target value. Consequently, the reflection density data of five points are obtained as illustrated by round marks in FIG. 9. The developing condition under which the reflection density reaches 1.0 is located in a section in which the DC voltage component Vdc exists between −400V and −450V. Assuming that a proportional relation is approximately achieved between the DC voltage component and the reflection density in this section, it may be estimated that the reflection density obtained at the time of the DC voltage component of about −420V reaches 1.0 as a result of internally dividing the reflection density at the time of the DC voltage component of −400V and that at the time of the DC voltage component of −450V. Therefore, as the image forming condition in the present example, the DC voltage component Vdc of the developing bias is controlled to −420V.

Although the number of image patches is five in the above described example, it should be noted that the number of the image patches may be increased to make the grade in change of the developing bias more minutely so that the DC voltage component of the developing bias can be accurately controlled.

The printing ratio of the halftone pattern may be changed to a different ratio so as to obtain a different density target value. However, if the printing ratio is too high or too low, the linearity between the developing bias and the density which are density variable parameters will be deteriorated, and a control value will be seldom changed, or conversely, it will be greatly changed resulting in the lack of stability. Therefore, the printing ratio of the halftone pattern which is ordinarily selected is set to 50% to 80%.

While the image forming conditions greatly depend not only on the variation in the sensitivity of the photosensitive drum 1 (variation due to temperature or humidity or durability variation), but also the unevenness in the sensitivity upon manufacturing of the photosensitive drum 1 or toner or in the charging characteristic and unevenness in the exposure amount of laser or the like, these variations can be absorbed to a certain degree and a stable image forming operation can be carried out by controlling the density as described above.

When any of the above described variation factors is large and cannot be met only by the developing bias potential, the above variation factor can be also controlled by combining the developing bias potential condition with a charging condition or an exposure condition (exposure amount).

The density control system described in the above mentioned conventional example is relatively effective for forming an image such as a photographic image including a halftone part as a main body. However, in case of an image strong in an image contrast which includes characters or graphs (an image is similar to a binary image which has few halftone parts), the above density control system has not necessarily established a proper image forming condition in view of the impression of the image. In practice, most of the images printed by a user have been images mainly including characters as in the latter case, and therefore, they have frequently encountered various problems.

After the density control described in the conventional example is carried out by employing the photosensitive drums 1 different in sensitivity, the area gradation patterns of 1/16 to 16/16 shown in FIG. 5 are printed, and the densities thereof are plotted and the plotted results are shown in FIG. 10. Referring to FIG. 10, a solid line indicates the sensitivity upon use of the photosensitive drum 1 with normal sensitivity and a broken line indicates the sensitivity upon use of the photosensitive drum 1 with high sensitivity. In this case, the surface potential of the photosensitive drum 1 is set to −600V and the exposure amount of the laser is equal to that of the conventional example.

Assuming that the surface potential of the photosensitive drum 1 in a laser exposed part is V1, V1 of the photosensitive drum 1 with normal sensitivity was approximately −200V and V1 of the photosensitive drum 1 with high sensitivity was approximately −120V. When the density control mentioned in the conventional example was applied to them, the DC voltage component Vdc of the developing bias potential selected by the photosensitive drum 1 with normal sensitivity was about −420V and the DC voltage component Vdc of the developing bias potential selected by the photosensitive drum 1 with high sensitivity was about −320V. When the difference between Vdc and V1 is represented as a developing contrast Vc for each of the photosensitive drums 1, Vc for the photosensitive drum 1 with normal sensitivity is about −220V and Vc for the photosensitive drum 1 with high sensitivity is about −200V.

As is apparent from FIG. 10, while the density on the photosensitive drum 1 with normal sensitivity substantially corresponds to that of the photosensitive drum 1 with high sensitivity in the pattern of the printing ratio of 9/16 which serves as a reference for density control, the density of the photosensitive drum 1 with high sensitivity is liable to be higher than that of the photosensitive drum 1 with normal sensitivity in the patterns having lower printing ratio and the density of the photosensitive drum 1 with normal sensitivity tends to be higher than that of the photosensitive drum 1 with high sensitivity in the patterns having the printing ratio exceeding 9/16.

The above mentioned phenomenon can be explained in the following. Since the latent image of an isolated dot on the photosensitive drum 1 with high sensitivity is deeper than that on the photosensitive drum 1 with normal sensitivity, the density on the photosensitive drum 1 with high sensitivity in the patterns low in printing ratio becomes deeper under the same developing contrast. However, as the printing ratio becomes higher, the difference in depth of the latent image between the photosensitive drum 1 with high sensitivity and the photosensitive drum 1 with normal sensitivity substantially disappears, so that the densities on the photosensitive drums 1 with high and normal sensitivity converge to the substantially same density.

The density of the photosensitive drum 1 with high sensitivity in the pattern of the printing ratio of 9/16 is slightly higher than that of the photosensitive drum 1 with normal sensitivity under the same developing contrast. However, since the density control is performed so that the density of the photosensitive drum 1 with high sensitivity corresponds to that of the photosensitive drum 1 with normal sensitivity, the developing bias potential with a slightly low developing contrast is selected. Therefore, in an image including characters or graphs having a high printing ratio, the developing contrast may possibly become insufficient, hence the characters or lines may be liable to be thinned. When the sensitivity of the photosensitive drum 1 is lowered, an action reverse to that mentioned above inconveniently operates and the developing contrast becomes more than enough so that the characters or lines tend to be thickened. Although the degree of the above tendency may be small or large, this tendency is necessarily generated regardless of the kind of toner.

Generally speaking, the sensitivity of the photosensitive drum 1 tends to be high under a high temperature and high humidity environment. On the contrary, the sensitivity of the photosensitive drum 1 tends to be low under a low temperature and low humidity environment. As the shift of sensitivity of the photosensitive drum 1 is increased, the above mentioned bad effect is apt to be more apparently generated, which has caused a problem from the viewpoint of density control.

Further, when the shift of sensitivity of the photosensitive drum is large as described above, a color balance may collapse due to the influence of the developing characteristic or the like peculiar to each color, and therefore, a method for correcting the collapse of color balance has been also demanded.

As mentioned above, not only the developing bias potential is employed as density control parameters, but also the charging potential or the exposure amount are individually adjusted, so that the quality of printing may be maintained. However, in this instance, not only a control system becomes complicated, but also density control patterns need to be repeatedly printed many times by changing settings, so that time required for control or the amount of consumed toner is increased. Therefore, a more simple and effective density control system has been required.

SUMMARY OF THE INVENTION

One of the objects of the present invention is to provide an image forming apparatus in which a proper image density can be realized by the improvement of density control and a high quality image can be obtained even when the density characteristic of the image is changed.

Another object of the present invention is to provide an image forming apparatus in which a good image can be formed regardless of the change of a density characteristic such as the shift of sensitivity of an image bearing member.

Other characteristics and objects of the present invention will be more obvious on reading the detailed description which follows given in reference to the attached drawings.

DETAILED DESCRIPTION OF THE PREFERRED EMBODIMENTS

Referring now to the accompanying drawings, embodiments of the image forming apparatus according to the present invention will be described in detail.

Embodiment 1

Figure 1:
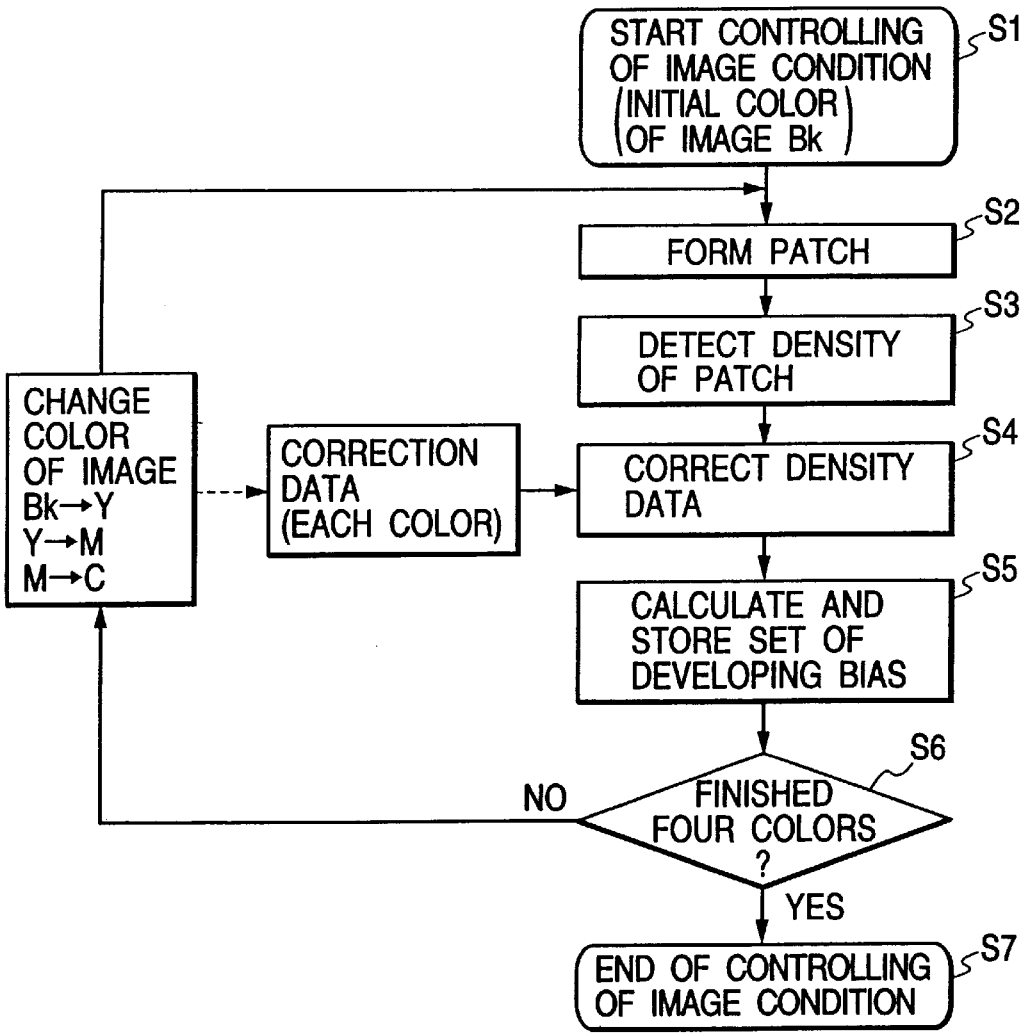
FIG. 1 is a flowchart showing a density control method for controlling density in an embodiment of an image forming apparatus according to the present invention.
Figure 8:
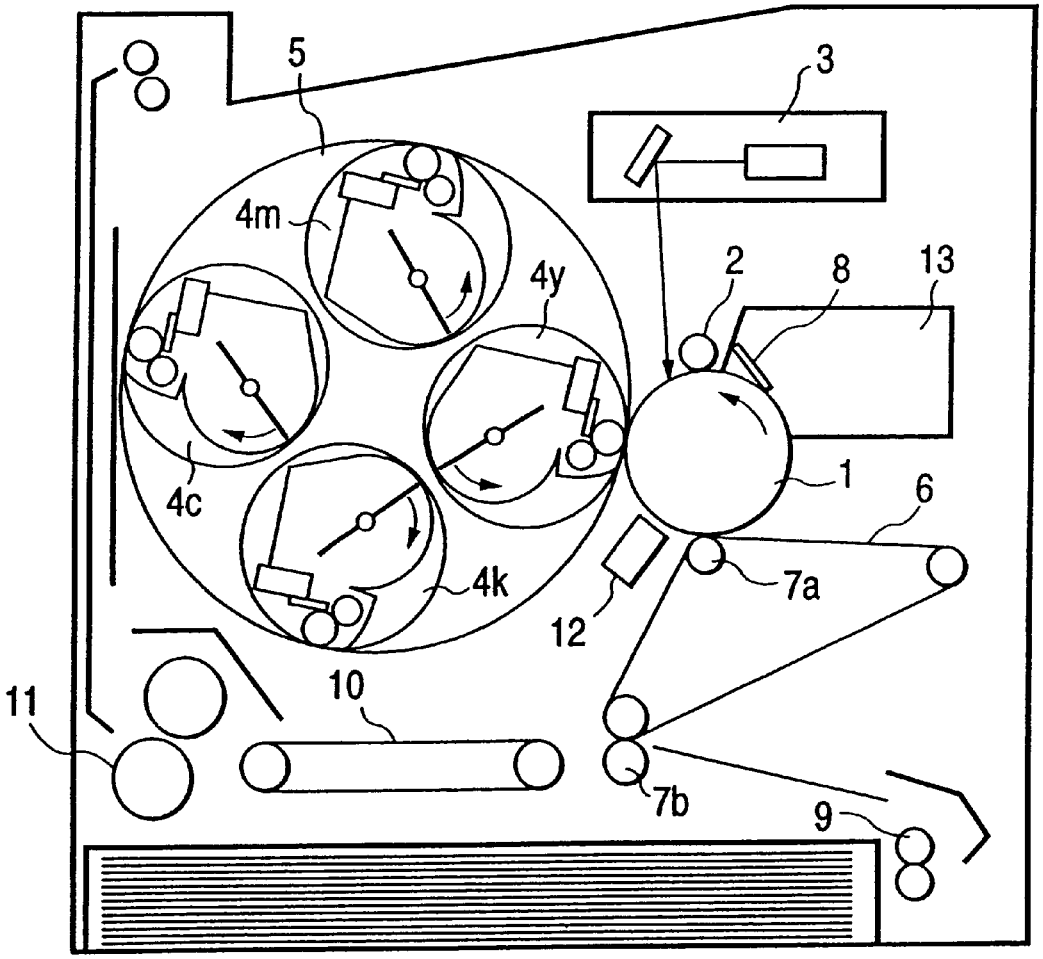
FIG. 8 PRIOR ART
FIG. 8 is a schematic view showing a conventional image forming apparatus.
Figure 9:
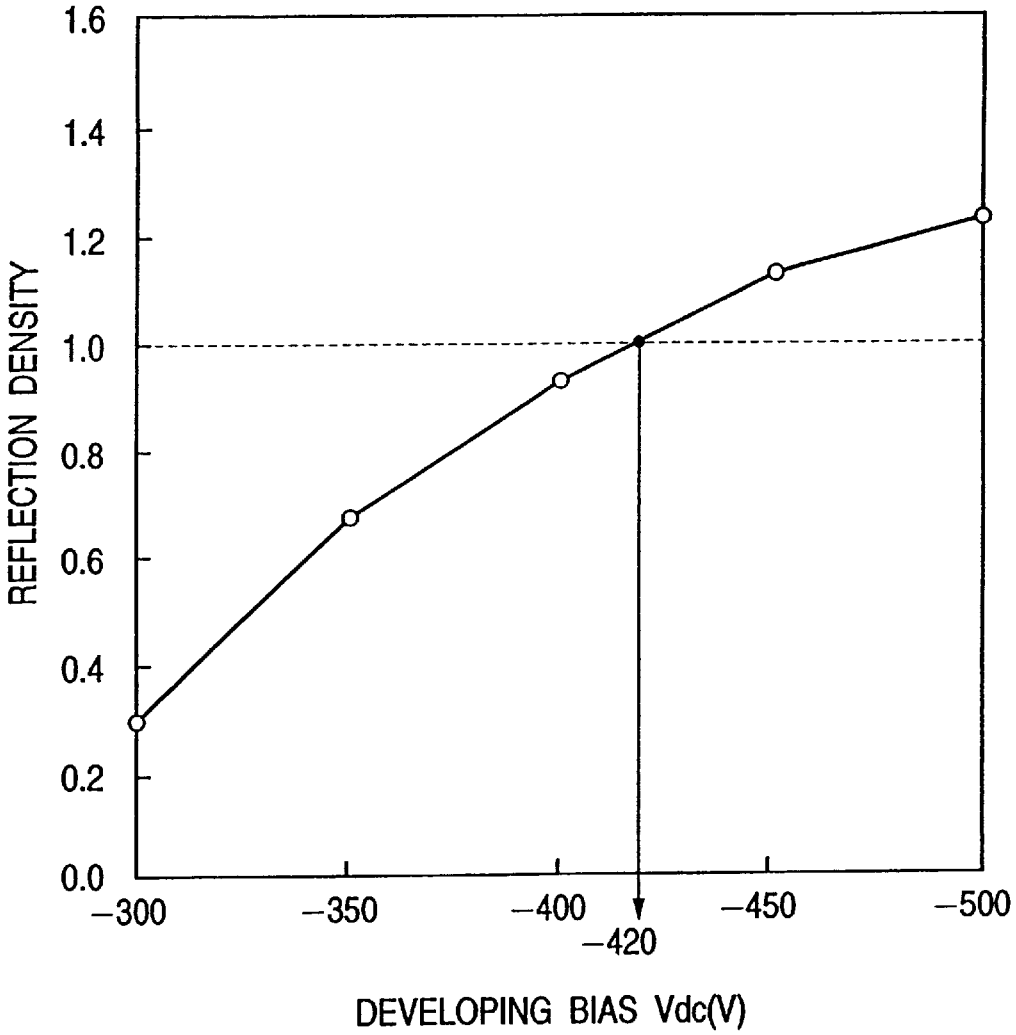
FIG. 9 PRIOR ART
FIG. 9 is an explanatory view showing a conventional bias control method.
Figure 10:
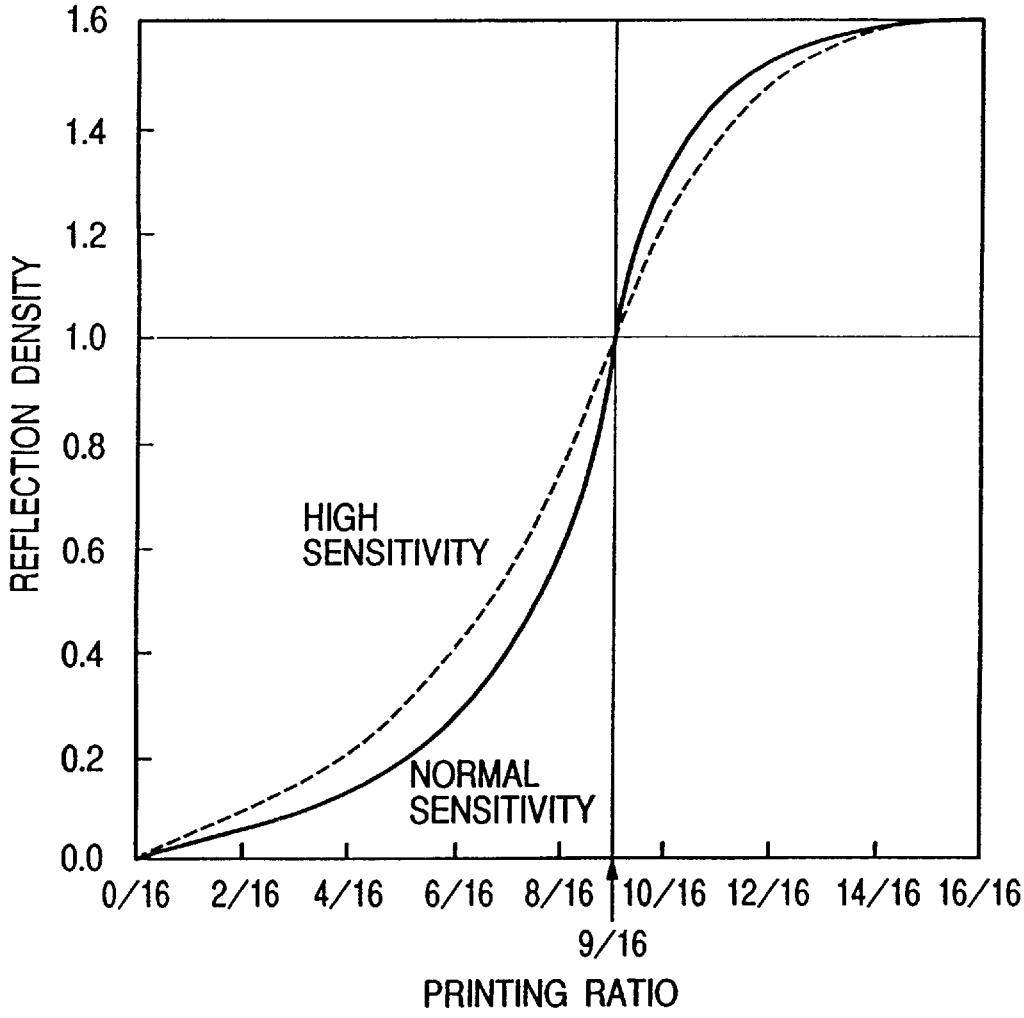
FIG. 10 PRIOR ART
FIG. 10 is an explanatory view showing the difference in density of the images of patterns printed by performing the conventional bias control, which is due to the difference in sensitivity of drums.

FIG. 1 is a flowchart showing a density control method in one embodiment of the color image forming apparatus according to the present invention. The present invention is mainly characterized by its density control method and is materialized by a color image forming apparatus illustrated in FIG. 8. Since the entire configuration and functions of the image forming apparatus according to the present invention are the same as those described with reference to FIG. 8, the explanation thereof will be omitted and the characteristic parts of the present invention will be described hereinafter.

In the present embodiment of the invention, an image is formed in accordance with the sequence of colors of black, yellow, magenta and cyan. The difference in the transmission factor of light is taken into consideration in order to improve the quality of an image, and therefore, nonmagnetic toner is used for the colors of yellow, magenta and cyan and magnetic toner is used only for black.

Figure 3:
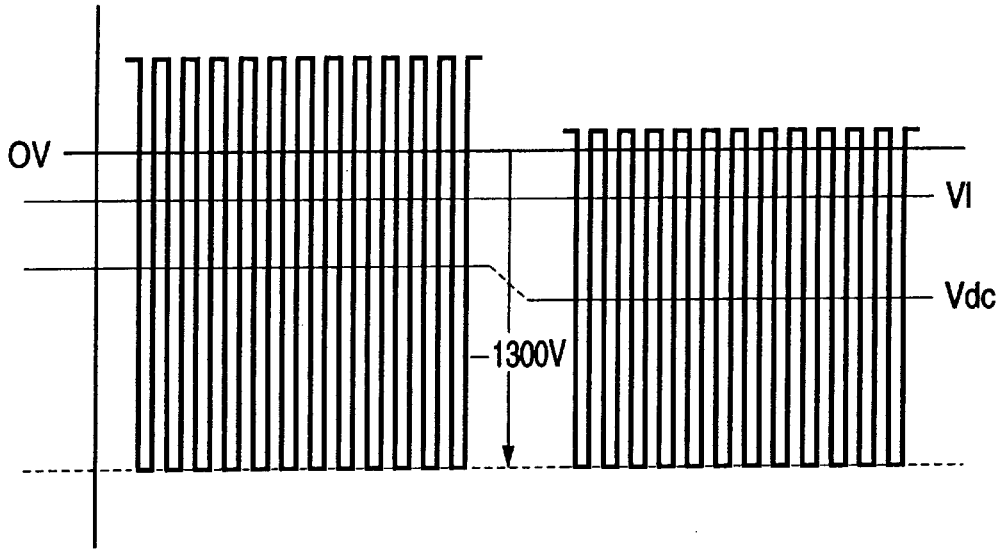
FIG. 3 is an explanatory view of developing bias applied upon use of nonmagnetic toner in the embodiment of FIG. 1.
Figure 4:
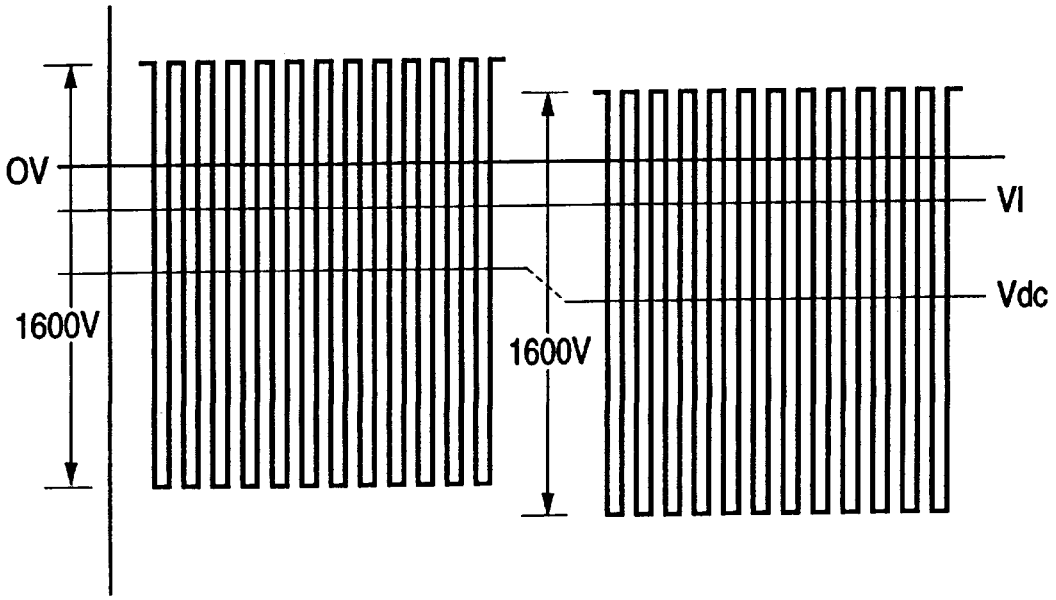
FIG. 4 is an explanatory view of developing bias applied upon use of magnetic toner in the embodiment of FIG. 1.

Since the attributes of toner respectively differ, developing bias is also optimized so as to meet the toner. In case of the nonmagnetic toner, maximum applied voltage is fixed to −1300V as illustrated in FIG. 3 and voltage between peaks Vpp is varied so that an actually effective DC voltage component Vdc is changed. In case of the magnetic toner, Vpp is fixed to 1600V as illustrated in FIG. 4 so that a DC voltage component is changed.

When the difference (called a "back contrast Vbc", hereinafter) between the charging bias potential Vd (the surface potential of an unexposed part) of a photosensitive drum 1 and developing bias potential Vdc is increased too much, irrespective as to whether the toner is magnetic or nonmagnetic, undesirable effects such as the deterioration of the quality of an image due to an edge effect, the increase of fog due to reversal toner, etc. are undesirably generated. Therefore, a density control is carried out by interlocking the developing bias potential Vdc with the charging bias potential Vd so that Vdc is not increased too much (If either Vdc or Vd is determined, the other will be unconditionally determined, so that they can not be individually moved). In order to simplify an explanation, a set of the above described developing bias potential and the charging bias potential will be represented only by the effective DC voltage component Vdc of the developing bias potential and will be simply referred to as "bias set Vdc", hereinafter.

Figure 5:
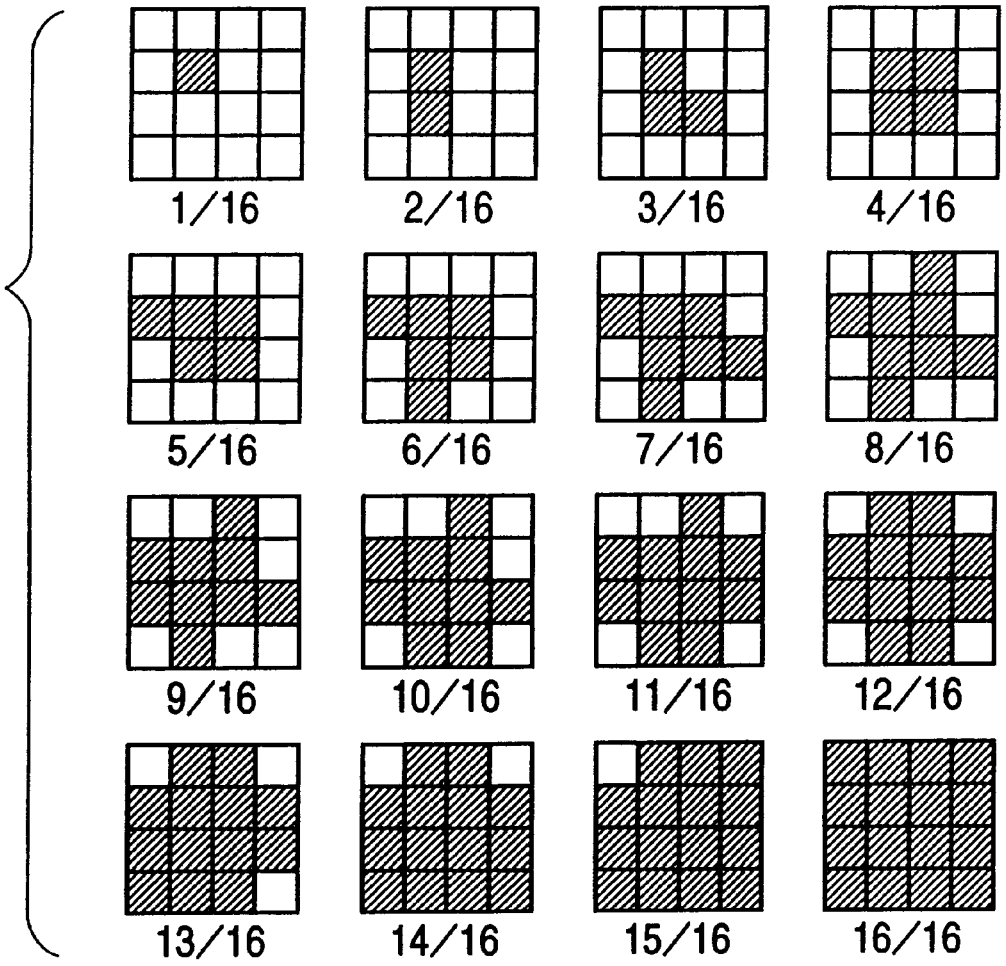
FIG. 5 is an explanatory view showing halftone patterns for measuring density employed in the present invention.
Figure 6:
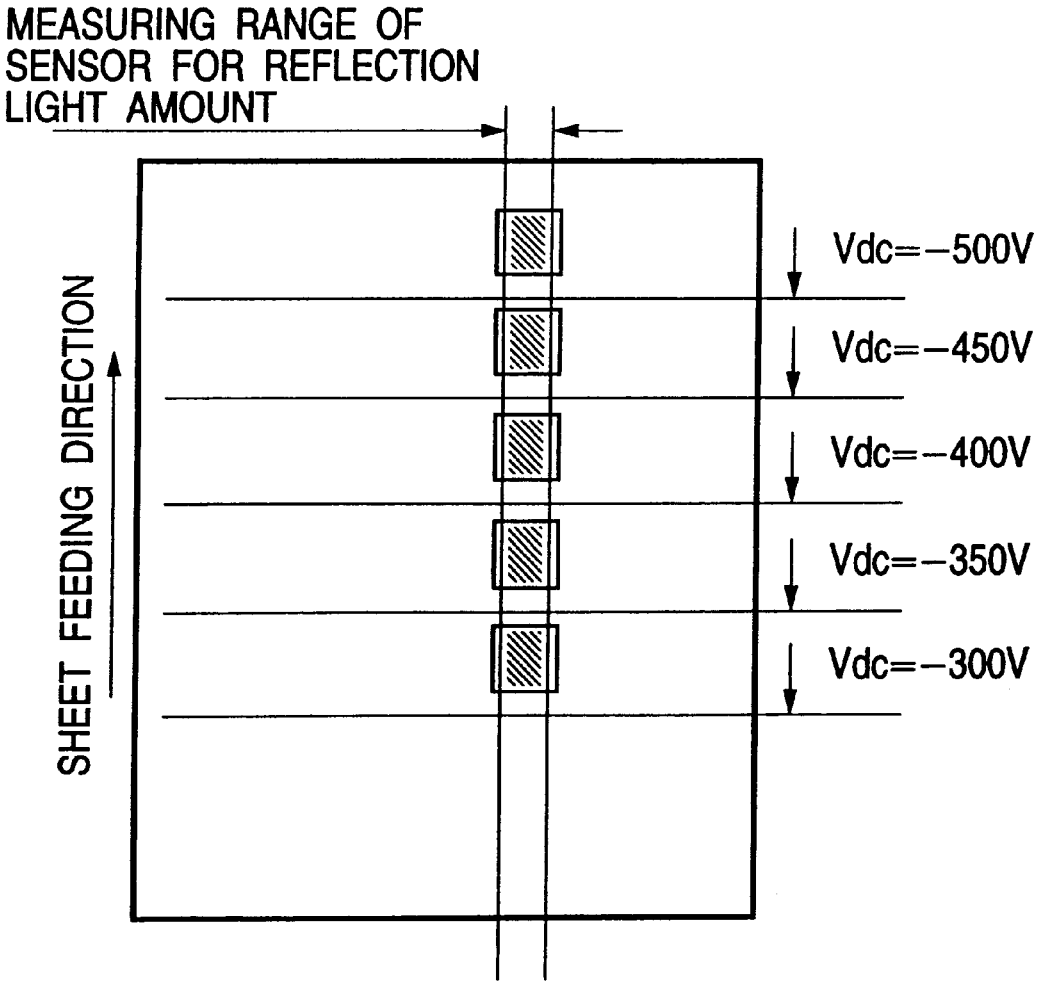
FIG. 6 is an explanatory view showing the printing examples of the halftone patterns for measuring density in the present invention.

A density determining method of the present embodiment will be described by referring to FIG. 2. As illustrated in the conventional example, prior to an normal image forming, a plurality of image patches of the halftone patterns of 30 mm angle are printed at intervals in a section where a reflection light amount sensor 12 is disposed. The respective image patches are developed under different bias sets Vdc and the reflection light amount of each of the image 11 patches is measured by the reflection light amount sensor 12.

to a latent image condition in the present embodiment, the sensitivity of the photosensitive drum 1 and the quantity of exposure to laser are adjusted so that V1 is about −200V when Vd is −600V under normal temperature and normal humidity (23° C., 60% Rh). As the detecting images, five image patches of square with side 30 mm angle are printed by employing the halftone pattern with the printing ratio of 9/16 illustrated in FIG. 5. The bias set Vdc is changed at intervals of 50V from −300V to −500V as illustrated by round marks in FIG. 2.

The density of the image patches formed in the step S2 is measured by the reflection light amount sensor 12 and the density data of each image patch is obtained (S3). An example of the measured results is shown in Table 1.

TABLE 1

| Bias set | −300V | −350V | −400V | −450V | −500V |
|---|---|---|---|---|---|
| Actually measured density data | 0.67 | 0.96 | 1.17 | 1.34 | 1.43 |
| Corrected density data | −0.20 | −0.10 | 0.00 | 0.10 | 0.20 |
| Calculated data | 0.47 | 0.66 | 1.17 | 1.44 | 1.63 |

Figure 2:
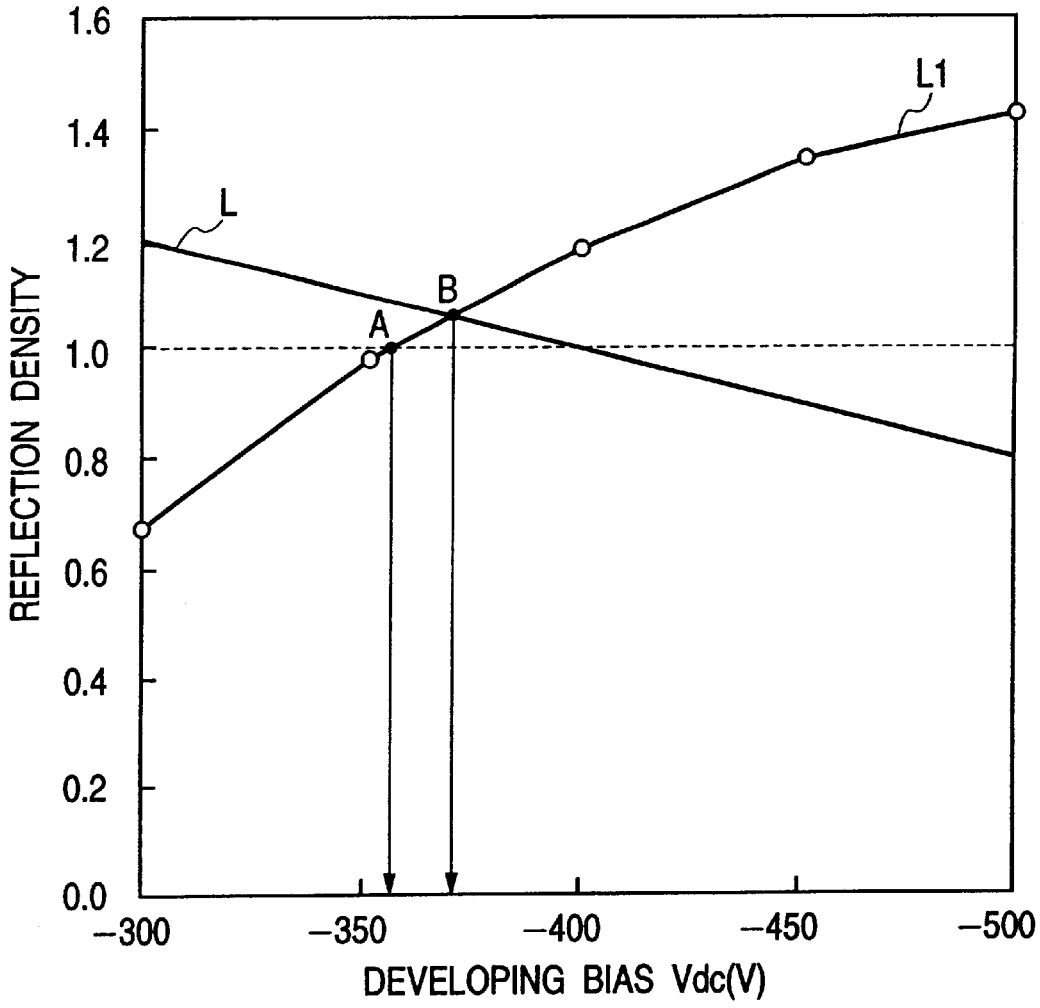
FIG. 2 is an explanatory view showing a bias control method in the embodiment of FIG. 1.

In the conventional example, while the target value of the reflection density is fixed to 1.0 (shown by a broken line in FIG. 2), in the present embodiment, target values are respectively different depending on bias sets Vdc and represented by values having such an inclination as shown by a solid line L in FIG. 2. The target values shown by the solid line L are derived from the result obtained by intentionally changing the sensitivity of the photosensitive drum 1 (for instance, changing the temperature and humidity environment) and adjusting the target values so that characters are represented by suitable images. In the conventional density control, while a bias set which corresponds to the intersection point A of a line for connecting together two points of the actually measured density data L1 of the image patches which sandwich the broken line in FIG. 2 therebetween and the broken line is selected, in the present embodiment, the intersection point B of the line for connecting together two points of the actually measured density data L1 and the solid line L is selected.

Now, the control procedure of the present embodiment will be described below in accordance with a control flow shown in FIG. 1. In step S1, when a request for controlling image conditions enters the controlling means of an image forming apparatus main body, a sequence of controlling of image conditions is started. The request for controlling the image conditions is automatically carried out when the power of the apparatus main body is turned on, each cartridge is replaced by a new cartridge the number of sheets on which characters are printed reaches prescribed values or the like.

Then, an image pattern for detecting a first color of black (Bk) is formed on the photosensitive drum 1 (S2). According The corrected density data of black which is previously stored in the ROM (read only memory) of the controlling means is added to the density data obtained in the step S3 (S4). The corrected density data indicates the density difference data of the broken line relative to the solid line L for each bias set under which the image patch is printed in FIG. 2 and density target values determined relative to a standard density target value (here, 1.0) which is determined without depending on the condition of development or the condition of the latent image. The corrected density data and the calculated data after the addition of the corrected density data are shown in the above Table 1.

A linear approximation is performed from two data nearest to the standard density target value of 1.0 based on the calculated data as in the conventional example, and a bias set Vdc the calculated data of which is 1.0 is obtained by an internal division (S5). This simply means an operation for gaining the intersection point B in FIG. 2.

The above described steps S2 to S5 are carried out for each of the colors of yellow (Y), magenta (M) and cyan (C) (S6). The density target values of the colors of yellow, magenta and cyan are respectively different. Since the developing characteristics of the colors including yellow, magenta and cyan are not necessarily proportional to Vdc, the density target values of them are set to those as shown in Table 2 by considering a color balance or the like. In the present embodiment, since the density of the image is controlled by attaching importance to the quality of a character image, the density target value data of black (Bk) is more seriously corrected relative to the standard density target value than those of other colors.

TABLE 2

| Bias set | −300V | −350V | −400V | −450V | −500V |
|---|---|---|---|---|---|
| Bk density target value | 1.20 | 1.10 | 1.00 | 0.90 | 0.80 |
| Y density target value | 1.15 | 1.05 | 1.00 | 0.95 | 0.10 |
| M density target value | 1.05 | 1.02 | 1.00 | 0.98 | 0.95 |
| C density target value | 1.05 | 1.02 | 1.00 | 1.00 | 1.00 |

The gist of the present invention resides in the improvement of a method for reading a plurality of pattern images visualized by changing image forming conditions (a developing condition or a latent image condition or both of these conditions) by a density detecting means and the image forming conditions upon forming of an image are automatically controlled based on the read density data, which have been conventionally carried out and in the provision of a control system for obtaining a better output result by correcting density target values in accordance with the selected image forming conditions. In other words, the density target values set so as to meet the image forming conditions to a recording material (a transfer material) are changed in accordance with the change of the density characteristics (see L1 in FIG. 2) of a plurality of image patches. The density characteristic shifts, depending on the sensitivity of the photosensitive member or the like, from L1 in FIG. 2.

In the present embodiment, although the standard density target value determined without depending on the developing condition or the latent image condition is a common value (1.0) regardless of the color of toner, needless to say, the standard density target value may be different for each color if density target value data is not changed. For instance, in the case that the transmission factor of the infrared light of yellow toner is slightly different from that of other toner, and the detection accuracy of the yellow toner is lower than that of other toner from the viewpoint of the relation between the quantity of toner and the reflection light amount when the standard density target value is set to 1.0, may be done the treatments that the standard density target value of only yellow toner is set to 1.1 and the value of the corrected density data is lowered by 0.1. Further, if the printing ratio of the image patch for detecting density is changed for each color and the standard density target value and the value of corrected density data are accordingly changed, these operations will not be contrary to the gist of the present invention.

According to the system of the present embodiment, for example, if any shift of sensitivity of the photosensitive drum 1 occurs due to the effect of temperature and humidity etc., the density of the image can be automatically controlled without deteriorating the quality of the image with characters.

In the present embodiment, the color image forming apparatus was described. However, of course, applying this invention to the black and white image forming apparatus is not contrary to the purport of this invention.

Further, in the present embodiment, the image forming condition may be at least one of an electrostatic image forming condition and a developing condition.

Embodiment 2

Now, another embodiment of the present invention will be described below.

Also in this embodiment, an image is formed in a sequence of colors of black, yellow, magenta and cyan as in the Embodiment 1. Nonmagnetic toner is employed for the colors of yellow, magenta and cyan and magnetic toner is employed only for black.

Developing bias potential is optimized so as to meet the toner. In case of the nonmagnetic toner, maximum applied voltage is fixed to −1300V and voltage between peaks Vpp is varied so that an actually effective DC voltage component Vdc is changed. In case of the magnetic toner, Vpp is fixed to 1600V so that a DC voltage component is changed.

In the present embodiment, the charging bias potential Vd is always made constant by considering bad effects such as the deterioration of the quality of an image due to an edge effect, the increase of fog due to reversal toner, etc. and a density control is carried out by interlocking the developing bias potential Vdc with the quantity of exposure L1 of the photosensitive drum 1 so that a back contrast Vbc is not changed too much (If either Vdc or Li is determined, the other will be unconditionally determined, so that they cannot be individually moved). In order to simplify an explanation in this embodiment, a set of the above described developing bias potential and the quantity of exposure will be represented only by the actually effective DC voltage component Vdc of the developing bias potential and will be simply referred to as "bias set Vdc", hereinafter.

Figure 7:
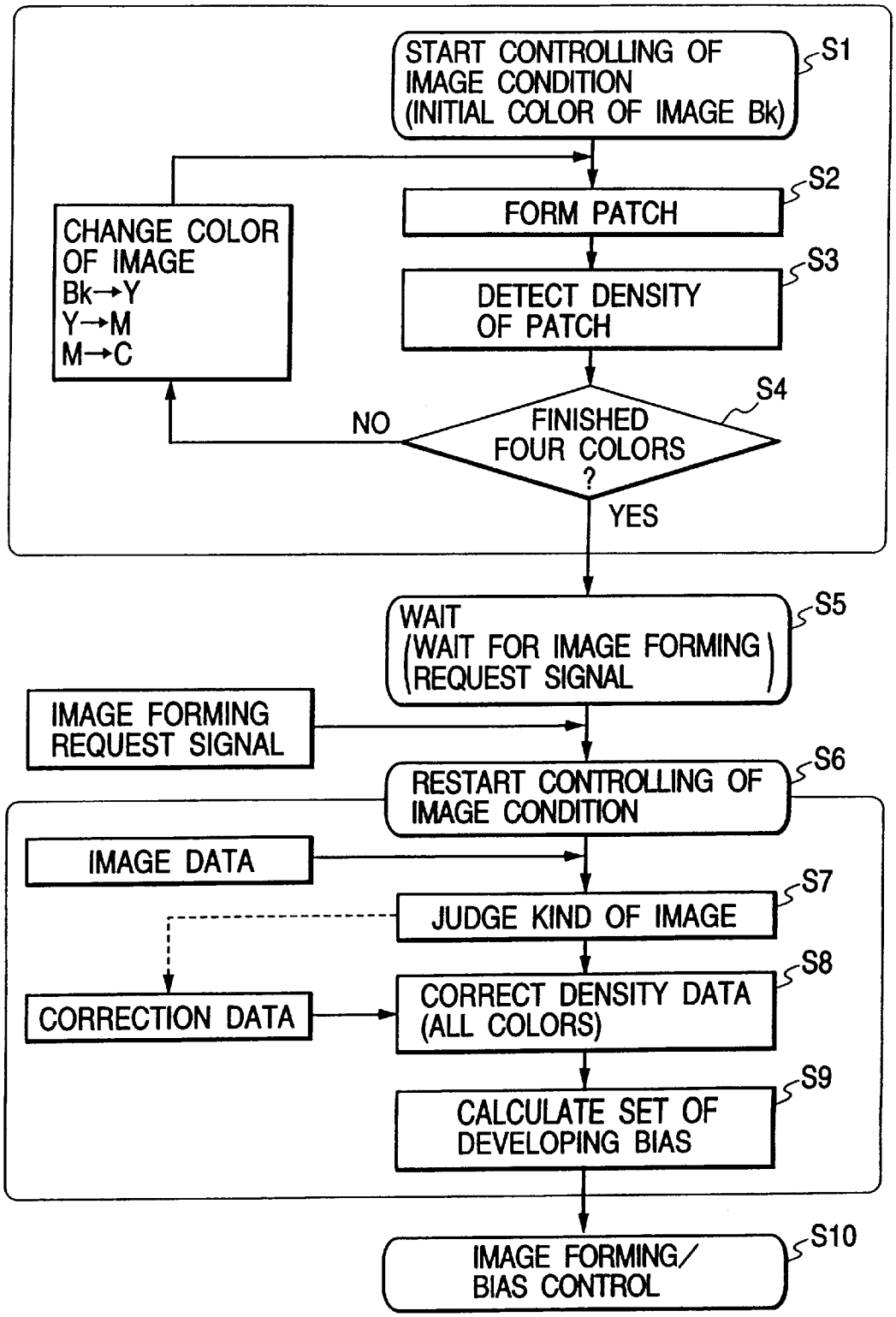
FIG. 7 is a flowchart showing a density control method in another embodiment according to the present invention.

Now, the control procedure of the present embodiment will be described below in accordance with a control flow shown in FIG. 7. In step S1, when a request for controlling image conditions enters the controlling means of an image forming apparatus main body, a sequence of controlling of image conditions is started.

Then, an image pattern for detecting a first color of black (Bk) is formed on the photosensitive drum 1 (S2). According to a latent image condition in the present embodiment, the sensitivity of the photosensitive drum 1 and the quantity of exposure to laser are adjusted so that V1 is about −200V when Vd is −600V under normal temperature and normal humidity (23° C., 60% Rh). As the detecting images, five image patches of square with side of 30 mm are printed by employing the halftone pattern with the printing ratio of 9/16 illustrated in FIG. 5. The developing bias Vd is changed at intervals of 50V from −300V to −500V while it is interlocked with the quantity of exposure Li.

The density of the image patches formed in the step S2 is measured by the reflection light amount sensor 12 and the density data of each image patch is obtained (S3). The above described steps S2 to S3 are carried out for each of the colors of yellow (Y), magenta (M) and cyan (C) (S4). When the density data of the respective colors is obtained, the procedure advances to step S5 so that the image forming apparatus enters a stand-by state (S5).

Then, when a request for forming images enters the controlling means of an apparatus main body, the control of image forming conditions is restarted (S6) and the kind of image data sent subsequently thereto is automatically decided (decide whether the image data mainly includes character images or photographic images) by a decision device (S7). The image data is decided based on whether the ratio of character images in the image data developed by the controlling means is not lower than a prescribed value. In case of the image data which has been already developed is sent, a mechanism for manually selecting the data by a user may be provided. Thus, the image forming apparatus may be switched to a character image mode suitable for images mainly including characters or to a halftone image mode suitable for halftone images.

After that, the corrected density data of each color which corresponds to the kind of the image decided in the step S7 is added to the density data obtained in the step S3 (S8). The above described corrected density data is previously stored in the ROM of the controlling means. For instance, for black, the density target value of the images mainly including characters and the density target value of the images mainly including photographs are set. The corrected density data indicates density target value data for each bias set under which the image patch is printed and is determined relative to the standard density target value 1.0 determined regardless of the developing condition or the latent image condition. The corrected density data of the images including characters as main components and the images including photographs as main components in the present embodiment are shown in Table 3.

TABLE 3

| Bias set | | −300V | −350V | −400V | −450V | −500V |
|---|---|---|---|---|---|---|
| Density target value of | Bk | 1.20 | 1.10 | 1.00 | 0.90 | 0.80 |
| image mode including | Y | 1.15 | 1.05 | 1.00 | 0.95 | 0.90 |
| characters as main | M | 1.05 | 1.02 | 1.00 | 0.98 | 0.95 |
| components | C | 1.05 | 1.02 | 1.00 | 1.00 | 1.00 |
| Density target value of | Bk | 1.10 | 1.05 | 1.00 | 0.95 | 0.90 |
| image mode including | Y | 1.10 | 1.03 | 1.00 | 0.97 | 0.95 |
| photographs as main | M | 1.03 | 1.01 | 1.00 | 0.99 | 0.97 |
| components | C | 1.03 | 1.00 | 1.00 | 1.00 | 1.00 |

A linear approximation is performed from two data nearest to the standard density target value 1.0 based on the results of the step S8 as in Embodiment 1 and a bias set Vdc which is equal to 1.0 is obtained by an internal division (S9).

In the present embodiment, means for classifying the images is provided so that the developing condition or the latent image condition or both of these conditions can be optimized on the basis of the kinds of the images. In the present embodiment, although the images are classified into two kinds, it should be noted that the present invention is not limited thereto and the images may be classified into three kinds or more of images by adding an image forming condition specified for images or color graphic images in which characters and photographs are substantially in the ratio 1:1 and an optimum image forming condition may be selected for each image.

What is claimed is:

1. An image forming apparatus, comprising:

image forming means for forming an image on a recording material, and for forming a plurality of reference images under a predetermined different image forming condition before the image is formed on the recording material;

density detecting means for detecting respective density values of the plurality of reference images; and controlling means for controlling an image forming condition for forming the image on the recording material by said image forming means on the basis of respective density values of the plurality of reference images detected by said density detecting means, wherein said controlling means increases a density target value, determined in accordance with the image forming condition for forming the image on the recording material by said image forming means, as a density characteristic of the plurality of reference images detected bv said density detecting means increases.

2. An image forming apparatus according to claim 1, wherein said apparatus forms a color image on the recording material, and wherein a relation between a change in the density characteristic of the plurality of reference images detected by said density detecting means and the density target value when an image of a first color is formed is different from that when an image of a second color is formed.

3. An image forming apparatus according to claim 1, wherein said apparatus forms a color image on the recording material, and wherein said controlling means changes the density target value on the basis of a change in the density characteristic of the plurality of reference images detected by said density detecting means when an image of a first color is formed, and sets the density target value to a predetermined value regardless of the change in the density characteristic of the plurality of reference images detected by said density detecting means when an image of a second color is formed.

4. An image forming apparatus according to claim 1, wherein a relation between a change in the density characteristic of the plurality of reference images detected by said density detecting means and the density target value is changed in accordance with a pattern of the image which is formed on the recording material.

5. An image forming apparatus according to claim 1, wherein said apparatus is operable in a first mode, in which said apparatus mainly forms a character image on the recording material, and in a second mode, in which said apparatus mainly forms a halftone image on the recording material, and wherein a relation between a change in the density characteristic of the plurality of reference images detected by said density detecting means and the density target value is changed based on the mode of operation.

6. An image forming apparatus according to claim 1, wherein said image forming means comprises an image bearing member and transfer means for transferring an image from said image bearing member to the recording material.

7. An image forming apparatus according to claim 6, wherein said plurality of reference images are formed on said image bearing member and said density detecting means detects respective density values of the plurality of reference images on said image bearing member.

8. An image forming apparatus according to claim 6, wherein said image forming means further comprises an electrostatic image forming means for forming an electrostatic image on said image bearing member and developing means for developing the electrostatic image using a developer, and wherein each of the predetermined different image forming condition and the image forming condition controlled by the controlling means is at least one of an electrostatic image forming condition of said electrostatic image forming means and a developing condition of said developing means.

9. An image forming apparatus according to claim 8, wherein the plurality of reference images have the same pattern, and the developing conditions of said developing means are different when each of the plurality of reference images are formed.

10. An image forming apparatus according to claim 9, wherein the developing conditions are developing bias voltages applied to said developing means, and wherein the density target value increases when the developing bias voltages corresponding to the image forming condition controlled by the controlling means decrease.

11. An image forming apparatus according to claim 6, wherein said image bearing member is a photosensitive member.

12. An image forming apparatus according to claim 1, wherein each of the plurality of reference images is a halftone pattern.

13. An image forming apparatus according to claim 1, wherein said controlling means controls the density target value which is variable in accordance with the plurality of reference images having a first density characteristic and is variable in accordance with the plurality of reference images having a second density characteristic, wherein the density target value is within a density range of the first and second density characteristics.

14. An image forming apparatus, comprising:

image forming means for forming an image on a recording material, and for forming a plurality of reference images under a predetermined different image forming condition before the image is formed on the recording material;

density detecting means for detecting respective density values of the plurality of reference images; and controlling means for controlling an image forming condition for forming the image on the recording material by said image forming means on the basis of the respective density values of the plurality of reference images detected by said density detecting means, wherein said controlling means controls a density target value which is variable in accordance with a plurality of reference images having a first density characteristic and is variable in accordance with a plurality of reference images having a second density characteristic, and wherein the density target value is within a density range of the first and second density characteristics.

15. An image forming apparatus according to claim 14, wherein said apparatus forms a color image on the recording material, and wherein the relation between a change in the density characteristics of the plurality of reference images detected by said density detecting means and the density target value when an image of a first color is formed is different from that when an image of a second color is formed.

16. An image forming apparatus according to claim 14, wherein said apparatus forms a color image on the recording material, and wherein said controlling means changes the density target value on the basis of a change in the density characteristics of the plurality of reference images detected by said density detecting means when an image of a first color is formed, and sets the density target value to a predetermined value regardless of the change in the density characteristics of the plurality of reference images detected by said density detecting means when an image of a second color is formed.

17. An image forming apparatus according to claim 14, wherein a relation between a change in the density characteristics of the plurality of reference images detected by said density detecting means and the density target value is changed in accordance with a pattern of the image which is formed on the recording material.

18. An image forming apparatus according to claim 14, wherein said apparatus is operable in a first mode, in which said apparatus mainly forms a character image on the recording material, and in a second mode, in which said apparatus mainly forms a halftone image on the recording material, and wherein a relation between a change in the density characteristics of the plurality of reference images detected by said density detecting means and the density target value is changed based on the mode of operation.

19. An image forming apparatus according to claim 14, wherein said image forming means comprises an image bearing member and transfer means for transferring an image from said image bearing member to the recording material.

20. An image forming apparatus according to claim 19, wherein said plurality of reference images are formed on said image bearing member and said density detecting means detects respective density values of the plurality of reference images on said image bearing member.

21. An image forming apparatus according to claim 19, wherein said image forming means further comprises an electrostatic image forming means for forming an electrostatic image on the image bearing member and developing means for developing the electrostatic image using a developer, and wherein each of the predetermined different image forming condition and the image forming condition controlled by the controlling means is at least one of an electrostatic image forming condition of said electrostatic image forming means and a developing condition of said developing means.

22. An image forming apparatus according to claim 21, wherein the plurality of reference images have the same pattern, and the developing conditions of said developing means are different when each of the plurality of reference images are formed.

23. An image forming apparatus according to claim 22, wherein the developing conditions are developing bias voltages applied to said developing means, and wherein the density target value increases when the developing bias voltages corresponding to the image forming condition controlled by the controlling means decrease.

24. An image forming apparatus according to claim 19, wherein said image bearing member is a photosensitive member.

25. An image forming apparatus according to claim 14, wherein each of the plurality of reference images is a halftone pattern.

* * * * *

UNITED STATES PATENT AND TRADEMARK OFFICE

CERTIFICATE OF CORRECTION

PATENT NO. : 6,226,466 B1
DATED : May 1, 2001
INVENTOR(S) : Masaki Ojima et al.

It is certified that error appears in the above-identified patent and that said Letters Patent is hereby corrected as shown below:

Column 5,
Line 28, "bad" should read -- undesirable --.

Column 7,
Line 51, "is" should read -- being -- and;
Line 51, "cartridge" should read -- cartridge, -- and;
Line 52, "reaches" should read -- reaching --.

Column 8,
Tab 1, "0.66" should read -- 0.86 -- and;

Column 9,
Line 33, ".detecting" should read -- detecting --;
Line 67, "bad" should read -- undesirable --.

Column 11,
Line 53, "bv" should read -- by --.

Column 14,
Line 25, "are" should read -- is --.

Signed and Sealed this

Eighth Day of January, 2002

*Attest:*

*Attesting Officer*

JAMES E. ROGAN
*Director of the United States Patent and Trademark Office*